US012791247B2

(12) United States Patent
Woodling

(10) Patent No.: US 12,791,247 B2
(45) Date of Patent: Nov. 10, 2026

(54) REFRIGERATION SYSTEM AND CONTAINER ASSEMBLIES

(71) Applicant: Midea Group Co., Ltd., Beijiao (CN)

(72) Inventor: Pierce R. Woodling, Louisville, KY (US)

(73) Assignee: Midea Group Co., Ltd., Foshan (CN)

( * ) Notice: Subject to any disclaimer, the term of this patent is extended or adjusted under 35 U.S.C. 154(b) by 215 days.

(21) Appl. No.: 18/400,562

(22) Filed: Dec. 29, 2023

(65) Prior Publication Data

US 2025/0216148 A1 Jul. 3, 2025

(51) Int. Cl.

| | |
|---|---|
| ***F25D 25/02*** | (2006.01) |
| ***A47B 45/00*** | (2006.01) |
| ***A47B 88/90*** | (2017.01) |
| ***B65D 21/08*** | (2006.01) |
| *F25D 23/06* | (2006.01) |

(52) U.S. Cl.

CPC ..... *F25D 25/025* (2013.01); *A47B 88/941* (2017.01); *A47B 45/00* (2013.01); *A47B 2210/175* (2013.01); *B65D 21/086* (2013.01); *F25D 23/069* (2013.01); *F25D 2325/021* (2013.01)

(58) Field of Classification Search

CPC ..... F25D 25/025; F25D 23/069; F25D 2325/021; A47B 88/90; A47B 88/941; A47B 2210/175; A47B 45/00; B65D 21/086

See application file for complete search history.

(56) References Cited

U.S. PATENT DOCUMENTS

| | | | | |
|---|---|---|---|---|
| 1,746,720 A * | 2/1930 | Sullivan | A47F 3/14 220/8 |
| 2,369,728 A * | 2/1945 | Farkas | A47G 23/06 220/8 |
| 2,907,487 A * | 10/1959 | Harrington | A47B 88/90 220/8 |
| 8,608,262 B1 * | 12/2013 | Daros | A47B 45/00 312/348.2 |
| 9,624,000 B1 * | 4/2017 | Mclaughlin | A47D 15/00 |

(Continued)

FOREIGN PATENT DOCUMENTS

| | | |
|---|---|---|
| CN | 207515348 U | 6/2018 |
| CN | 216977310 U | 7/2022 |
| CN | 218296401 U | 1/2023 |

(Continued)

*Primary Examiner* — Kimberley S Wright
(74) *Attorney, Agent, or Firm* — Dinsmore & Shohl LLP

(57) ABSTRACT

A container assembly includes a first bin and a second bin, each of the first bin and the second bin including a first section and a second section, the second section being translatable relative the first section in a longitudinal direction. A slider is disposed on the first section of each of the first bin and the second bin, and a rail is disposed on the second section of each of the first bin and the second bin, the rail engaging the slider to allow for translation of the second section relative the first section in the longitudinal direction. An attachment mechanism releasably couples the second section of the first bin and the second section of the second bin, and allows the first bin and the second bin to translate in tandem in the longitudinal direction and move independently in a lateral direction.

19 Claims, 7 Drawing Sheets

(56) References Cited

U.S. PATENT DOCUMENTS

| | | | | |
|---|---|---|---|---|
| 12,478,181 | B1 * | 11/2025 | Wang | A47B 45/00 |
| 2019/0137168 | A1 * | 5/2019 | Kumar | F25D 25/025 |

FOREIGN PATENT DOCUMENTS

| | | | | | |
|---|---|---|---|---|---|
| CN | 218544968 | U | | 2/2023 | |
| CN | 117490332 | A | * | 2/2024 | F25D 25/025 |
| IN | 202141039504 | A | | 7/2022 | |
| KR | 20120007646 | U | * | 11/2012 | A47B 88/941 |
| TM | M315321 | U | | 7/2007 | |

* cited by examiner

REFRIGERATION SYSTEM AND CONTAINER ASSEMBLIES

TECHNICAL FIELD

The present specification generally relates to refrigeration systems, and more specifically, to container assemblies having adjustable widths.

BACKGROUND

Existing refrigeration systems offer various containers having a number of features, such as crisper bins with humidity controls, full-length drawers for extended storage, and adjustable dividers within drawers for managing space. However, traditional containers are static in size and incapable of adjustment to accommodate the diverse shapes and sizes of fresh produce that consumers may wish to store. Accordingly, a need exists for a refrigeration system that offers an adjustable storage solution that permits customization of storage space while retaining the advantages of traditional refrigeration storage systems.

SUMMARY

In an embodiment, a refrigeration system is disclosed. The refrigeration system includes an internal cavity, a plurality of shelves and a plurality of drawers disposed within the internal cavity, and a container assembly disposed within the internal cavity. The container assembly includes a plurality of bins each including a first section and a second section; wherein the second section of each of the plurality of bins is translatable relative the first section of each of the plurality of bins in a longitudinal direction, such that translation of the second section of each of the plurality of bins relative the first section of each of the plurality of bins causes a bin width of each of the plurality of bins to be adjusted.

In another embodiment, a container assembly is disclosed. The container assembly includes a first bin and a second bin, each of the first bin and the second bin including a first section and a second section, the second section being translatable relative the first section in a longitudinal direction. A slider is disposed on the first section of each of the first bin and the second bin, and a rail is disposed on the second section of each of the first bin and the second bin, the rail engaging the slider to allow for translation of the second section relative the first section in the longitudinal direction. A partition is positioned between the first bin and the second bin, the partition including a partition attachment that is releasably coupled to the second section of the first bin and the second section of the second bin, and allows the first bin and the second bin to translate in tandem in the longitudinal direction and move independently in a lateral direction.

In yet another embodiment, a method of adjusting a width of a plurality of bins in a container assembly is disclosed. The method includes inserting a plurality of bins in the container assembly, the plurality of bins including a first bin and a second bin, each of the first bin and second bin having a first section and a second section that is translatable relative to the first section in a longitudinal direction; releasably coupling the second section of the first bin and the second section of the second bin to a partition positioned between the first bin and the second bin such that the second section of the first bin and the second section of the second bin translate in tandem in the longitudinal direction; and translating the second section of the first bin in a first direction such that a first bin width of the first bin increases and a second bin width of the second bin decreases an amount equal to the increase in the first bin width.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
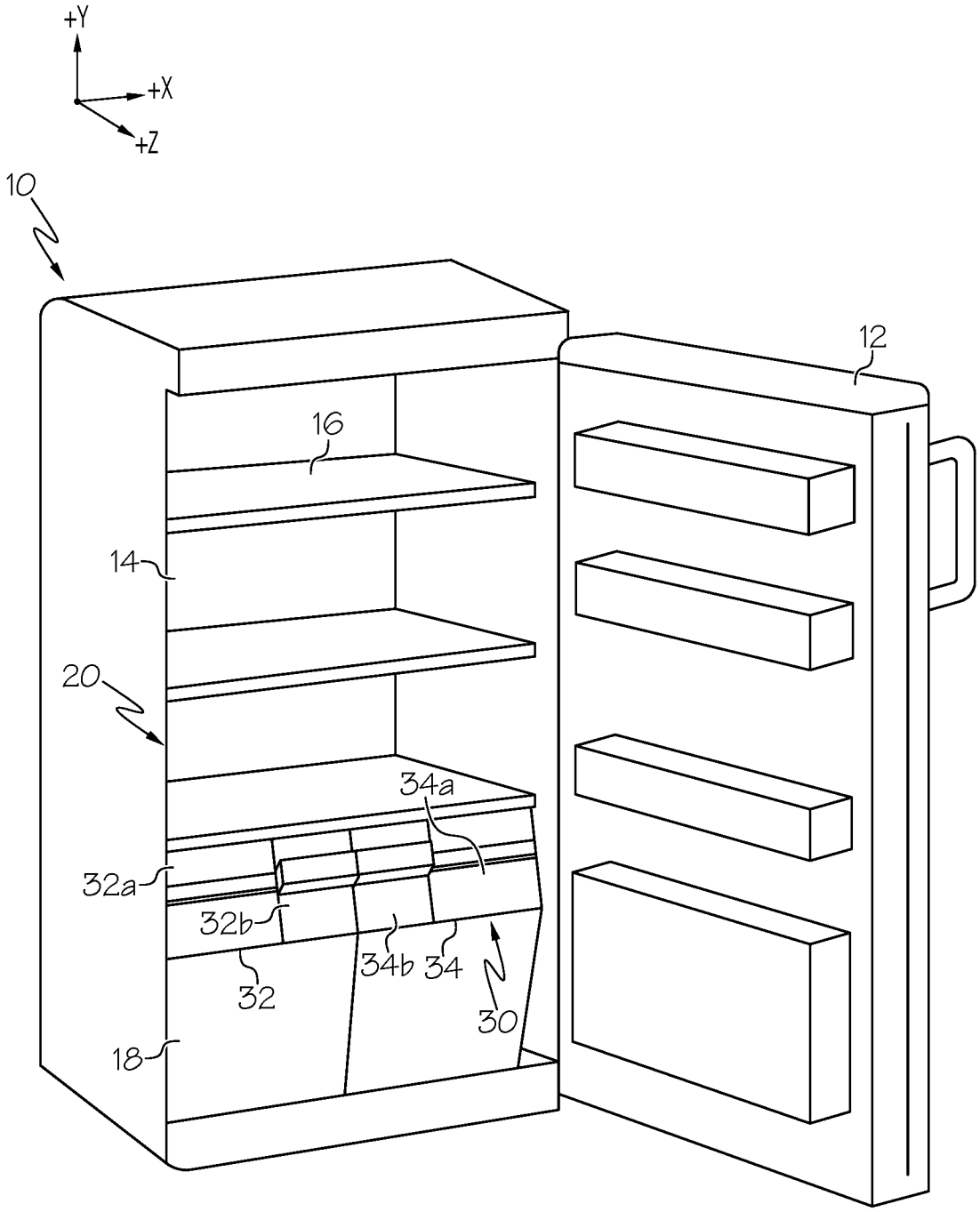
FIG. 1 depicts a perspective view of a refrigeration system including a container assembly, according to one or more embodiments shown and described herein.

Embodiments disclosed herein relate to refrigeration systems, container assemblies, and methods of adjusting bin widths of bins within a container assembly. More specifically, the present disclosure relates to a refrigeration system including a container assembly disposed within the internal cavity. The container assembly includes a plurality of bins each including a first section and a second section, with the second section of each of the plurality of bins being translatable relative to the first section of each of the plurality of bins in a longitudinal direction. Accordingly translation of the second section of each of the plurality of bins relative to the first section of each of the plurality of bins causes a bin width of each of the plurality of bins to be adjusted.

For example, in these embodiments, an attachment mechanism may be used to releasably couple the second section of each of the plurality of bins, such that the second sections of each of the plurality of bins move together in tandem when translated in the longitudinal direction. Accordingly, it should be appreciated that translating one of the plurality of bins in a first direction (e.g., to increase the bin width of one of the plurality of bins) results in an equal and opposite decrease in a width of an adjacent bin, such that the overall width of the container assembly is maintained. As a result, it may be possible to adjust the widths of each of the plurality of bins in order to accommodate items (e.g., food or otherwise) requiring specific storage space.

As should be appreciated, traditional refrigeration systems, including both domestic and commercial refrigerators and freezers, often come equipped with container assemblies (e.g., crispers, drawers, etc.) that allow for a user to organize items (e.g., produce, meat, etc.) within the refrigeration system. While these traditional container assemblies offer a variety of features aimed at maintaining freshness of items (e.g., humidity controls, etc), these assemblies often have static dimensions and include a plurality of bins arranged side-by-side. Because of the fixed dimensions of traditional container assemblies, users may be unable to accommodate produce having large or unusual shapes (e.g., prolate shapes, cucumbers, bananas, squash, etc.) within a refrigeration system.

The disclosed refrigeration system addresses these shortcomings by providing a container assembly having a plurality of modular bins that may be manipulated to adjust a width of each individual bin in the container assembly. The adjustable nature of the plurality of bins may allow for enhanced storage flexibility within the refrigeration system, such that a user may tailor the size of each of the bins within the container assembly to accommodate their specific storage needs. Furthermore, the disclosed container assembly allows for the adjustment of the individual bins in the container assembly without compromising the independent functionality of each bin. Accordingly, the refrigeration system and container assembly described herein may offer a significant improvement in user adaptability without sacrificing the features and/or benefits of traditional systems.

Embodiments of refrigeration systems, container assemblies, and methods of adjusting container assemblies will now be described in additional detail herein. The following will now describe these refrigeration systems, container assemblies, and methods in more detail with reference to the drawings and where like numbers refer to like structures.

As depicted in FIG. 1, a refrigeration system 10 is depicted. The refrigeration system 10 may include a door 12 and define an internal cavity 14, with a plurality of shelves 16 and/or drawers 18, such as freezer drawers, disposed within the cavity 14. In these embodiments, the refrigeration system 10 may further include a container assembly 20, with the container assembly 20 including a plurality of bins 30. For example, as depicted in FIG. 1, the container assembly 20 may include a first bin 32 and a second bin 34. Although the container assembly 20 depicted in FIG. 1 includes two bins (e.g., first bin 32 and second bin 34), it should be appreciated that the container assembly 20 may include any number of bins without departing from the scope of the present disclosure.

Referring still to FIG. 1, each of the plurality of bins 30 may include a first section 30*a* and a second section 30*b*. For example, the first bin 32 may include a first section 32*a* and a second section 32*b*, while the second bin 34 may similarly include a first section 34*a* and a second section 34*b*. In these embodiments, the first section 30*a* of each of the plurality of bins 30 may be fixed, such that the dimensions of the first section 30*a* of each of the plurality of bins 30 may be static. The second section 30*b* of each of the plurality of bins 30 may translate (e.g., in the +/−x-direction as depicted in the coordinate axis of FIG. 1) relative to the first section 30*a* of each of the plurality of bins 30. Accordingly, the translation of the second section 30*b* of each of the plurality of bins 30 relative to the first section 30*a* of each of the plurality of bins 30 may alter the overall dimensions (e.g., width) of each of the plurality of bins 30 within the container assembly 20. The adjustment and translation of each of the plurality of bins 30 will be described in additional detail herein with reference to FIGS. 2 and 3.

Although the container assembly 20 depicted in FIG. 1 is shown in use with refrigeration system 10, it should be appreciated that the container assembly 20 may be used in any number of applications without departing from the scope of the present disclosure. For example, the container assembly 20 may be incorporated into dressers and/or wardrobes, kitchen cabinets and/or pantries, tool storage and workbenches, office filing cabinets, art supplies and craft storage, or any other similar storage system without departing from the scope of the present disclosure.

Figure 2:
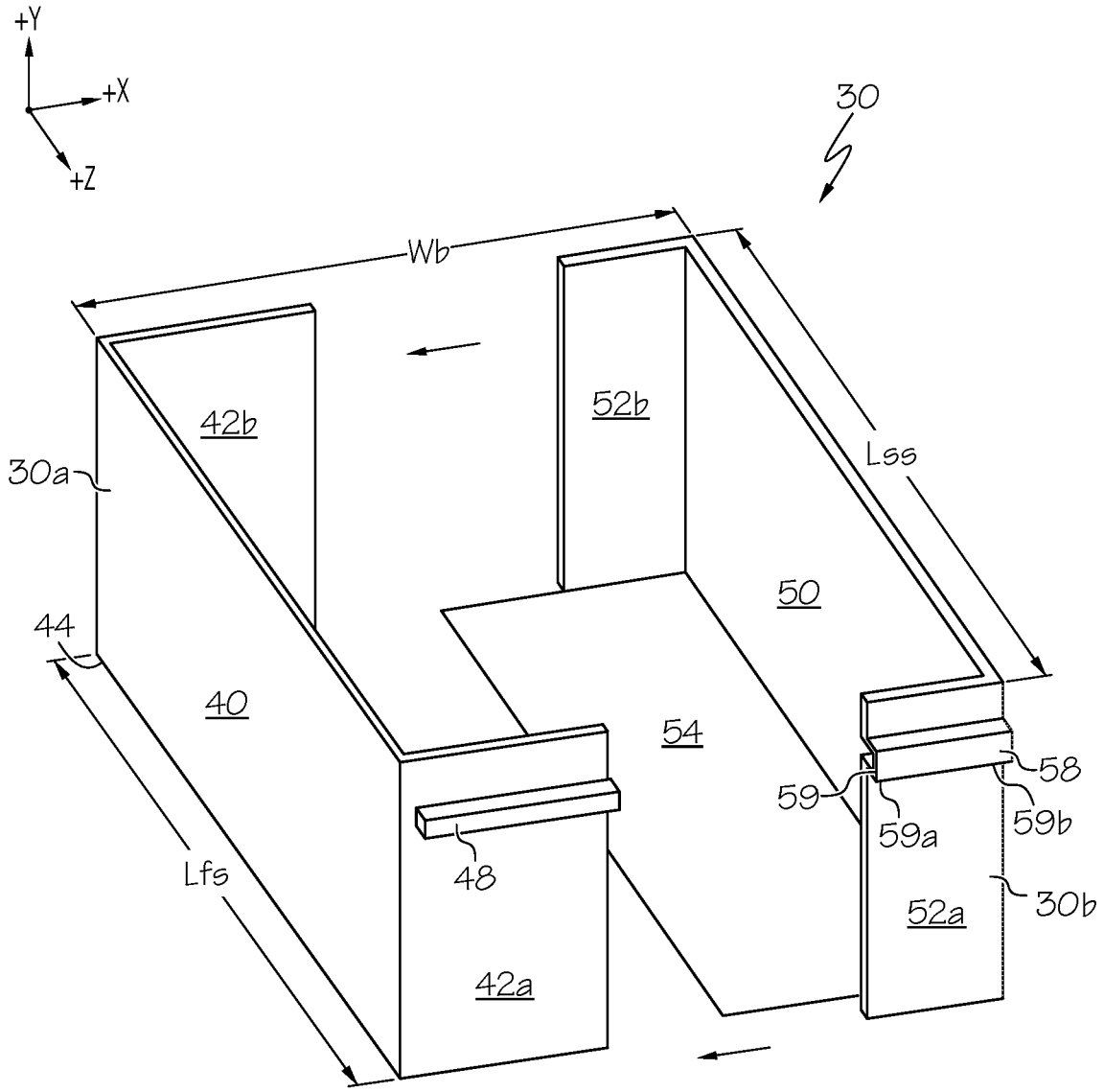
FIG. 2 depicts an exploded perspective view of a bin of the container assembly of FIG. 1, according to one or more embodiments shown and described herein.

Turning now to FIG. 2, an exemplary bin 30 of the container assembly 20 is depicted. As illustrated in FIG. 2, the bin 30 may include a first section 30*a* and a second section 30*b*, with the second section 30*b* being translatable in a longitudinal direction (e.g., in the +/−x-direction as depicted in the coordinate axis of FIG. 2) to adjust a bin width Wb of the bin 30.

In these embodiments, the first section 30*a* of the bin 30 may include a boundary wall 40, a pair of sidewalls 42 positioned adjacent the boundary wall 40, and a base board 44 (e.g., floor) that extends between the pair of sidewalls 42. For example, as depicted in FIG. 2, the first section 30*a* of the bin 30 may include a first sidewall 42*a* and a second sidewall 42*b* positioned opposite the first sidewall 42*a*, with the boundary wall 40 extending between a first (e.g., side) edge of the first sidewall 42*a* and the second sidewall 42*b* and the base board 44 extending between a bottom edge of the first sidewall 42*a* and the second sidewall 42*b*.

As further depicted in FIG. 2, at least one of the pair of sidewalls 42 may include a slider 48. For example, the first sidewall 42*a* may include a slider 48 that projects from a first surface of the first sidewall 42*a* (e.g., in the +z-direction as depicted in the coordinate axis of FIG. 2) and extends at least partially along a length of the first sidewall 42*a* (e.g. in the +/−x-direction as depicted in the coordinate axis of FIG. 2). In these embodiments, the slider 48 may be received by at least a portion of the second section 30*b* of the bin 30, such that the second section 30*b* of the bin 30 is capable of translating relative to the first section 30*a* of the bin 30 to adjust the bin width Wb of the bin 30, as will be described in additional detail herein. Referring still to FIG. 2, in these embodiments, the second section 30*b* of the bin 30 may include a boundary wall 50, a pair of sidewalls 52 positioned adjacent the boundary wall 50, and a base board 54 (e.g., floor) that extends between the pair of sidewalls 52. For example, second section 30*b* of the bin 30 may include a first sidewall 52*a* and a second sidewall 52*b* positioned opposite the first sidewall 52*a*, with the boundary wall 50 extending between a first (e.g., side) edge of the first sidewall 52*a* and the second sidewall 52*b*. In these embodiments, the base board 54 may have a baseboard width that is greater than a width of the sidewalls 52, such that the base board 54 extends outside of a perimeter of the sidewalls 52. By increasing the width of the base board 54, it may be possible to ensure that gaps are not formed along a bottom surface of the bin 30 as the second section 30*b* of the bin 30 translates relative the second section of the bin 30, as will be described in additional detail herein.

In these embodiments, at least one of the pair of sidewalls 52 may include a rail 58 that defines a recess 59 for receiving the slider 48 of the first section 30*a* of the bin 30. The recess 59 may extend across a length of the rail 58 (e.g., in the +/−x-direction as depicted in the coordinate axis of FIG. 2) such that the recess 59 extends through a first end 59*a* and a second end 59*b* of the rail 58. In the embodiments described herein, the rail 58 of the second section 30*b* may translate (e.g., slide, etc.) along the slider 48 formed on the first section 30*a* in order to adjust the bin width Wb of the bin 30. For example, translating the second section 30*b* in a first direction (e.g. in the −x-direction as depicted in the coordinate axis of FIG. 2) may cause the bin width Wb to narrow (e.g., decrease) while translating the second section 30*b* of the bin in a second direction opposite the first direction (e.g., in the +x-direction) may cause the bin width Wb to widen (e.g., increase).

Although the bin 30 depicted in FIG. 2 is illustrated as including a slider 48 and rail 58, it should be appreciated that the pair of sidewalls may include any mechanism that allows the first section and section 30*a*, 30*b* of the bin 30 to engage one another and translate relative one another. For example, in some embodiments, the first sidewall 42*a* may include a hooking mechanism configured to engage the rail 58 of the second sidewall 52*a*, such that the rail 58 may translate along the hooking mechanism. Accordingly, it should be understood that the embodiments described herein are illustrative in nature and are not intended to limit the scope of the present disclosure.

As previously described herein, as the second section 30*b* translates, the base board 54 of the second section 30*b* may similarly translate relative the base board 44 of the first section 30*a* of the bin 30. In these embodiments, the first section 30*a* and the second section 30*b* of the bin 30 may be configured such that the base board 54 of the second section translates above (e.g., in the +y-direction as depicted in the coordinate axis of FIG. 2) or below (e.g., in the −y-direction as depicted in the coordinate axis of FIG. 2) the base board 44 of the first section 30*a*. Accordingly, it may be possible to translate the second section 30*b* of the bin 30 relative the first section 30*a* of the bin 30 without forming any gaps between the base board 44 of the first section 30*a* of the bin 30 and the base board 54 of the second section 30*b* of the bin 30.

Furthermore, in the embodiments described herein, the first section 30*a* may include a first section length Lfs that is less than a second section length Lss of the second section 30*b* of the bin 30. It should be appreciated that, in these embodiments, configuring the second section 30*b* to be longer than the first section 30*a* may ensure that the second sidewall 52*b* of the second section 30*b* does not contact and/or interfere with the second sidewall 52*b* of the first section 30*a* as the second section 30*b* of the bin 30 is translated.

Referring still to FIG. 2, in these embodiments, it should be further appreciated that a width of the sidewalls 42 of the first section 30*a* and a width of the sidewalls 52 of the second section 30*b* of the bin 30 may be configured based on a width variance of the bin 30. For example, in the embodiments described herein, the second section 30*b* may be translated up to six inches in the first direction and second direction (e.g., in the +/−x-direction as depicted in the coordinate axis of FIG. 2) relative the first section 30*a*. Accordingly, the sidewalls 42 of the first section 30*a* and the sidewalls 52 of the second section 30*b* may be sufficiently wide to ensure that the rail 58 remains in contact with the slider 48 and no gaps are formed between the sidewalls 42, 52 of the first and second section 30*a*, 30*b* of the bin 30 as the second section 30*b* is translated. Furthermore, although not depicted, it should be appreciated that, in some embodiments, the second section 30*b* of the bin 30 may translate along an interior surface of the first section 30*a* of the bin 30. For example, the slider 48 of the first section 30*a* and the rail 58 of the second section 30*b* may be formed on inner surfaces of sidewalls 42, 52, respectively, such that the second section 30*b* translates within the first section 30*a* of the bin 30. It should be appreciated that, in these embodiments, the first section length Lfs may be greater than the second section length Lss in order to accommodate the second section 30*b* of the bin 30 within the first section 30*a* of the bin 30.

Referring still to FIG. 2, it should be further noted that the first section 30*a* and the second section 30*b* of the bin 30 may be configured in an opposite configuration without departing from the scope of the present disclosure. That is, in some embodiments, the first section 30*a* of the bin 30 may translate relative to the second section of the bin 30. In these embodiments, the first section 30*a* may include the rail 58 while the second section 30*b* of the bin 30 includes the slider 48.

Although not depicted, it should be appreciated that, in some embodiments, the bin 30 may be formed as a single, inseparable structure rather than including separate first and second sections. For example, in these embodiments, the first and second sections of the bin may be coupled by an adaptive base mechanism that allows at least one section of the bin (e.g., first or second section) to translate relative an opposite section of the bin to adjust the bin width of the bin. In these embodiments, the adaptive base mechanism may include a plurality of telescoping floor panels that expand as the first and/or second section of the bin are translated away from and/or towards one another, respectively.

Figure 3:
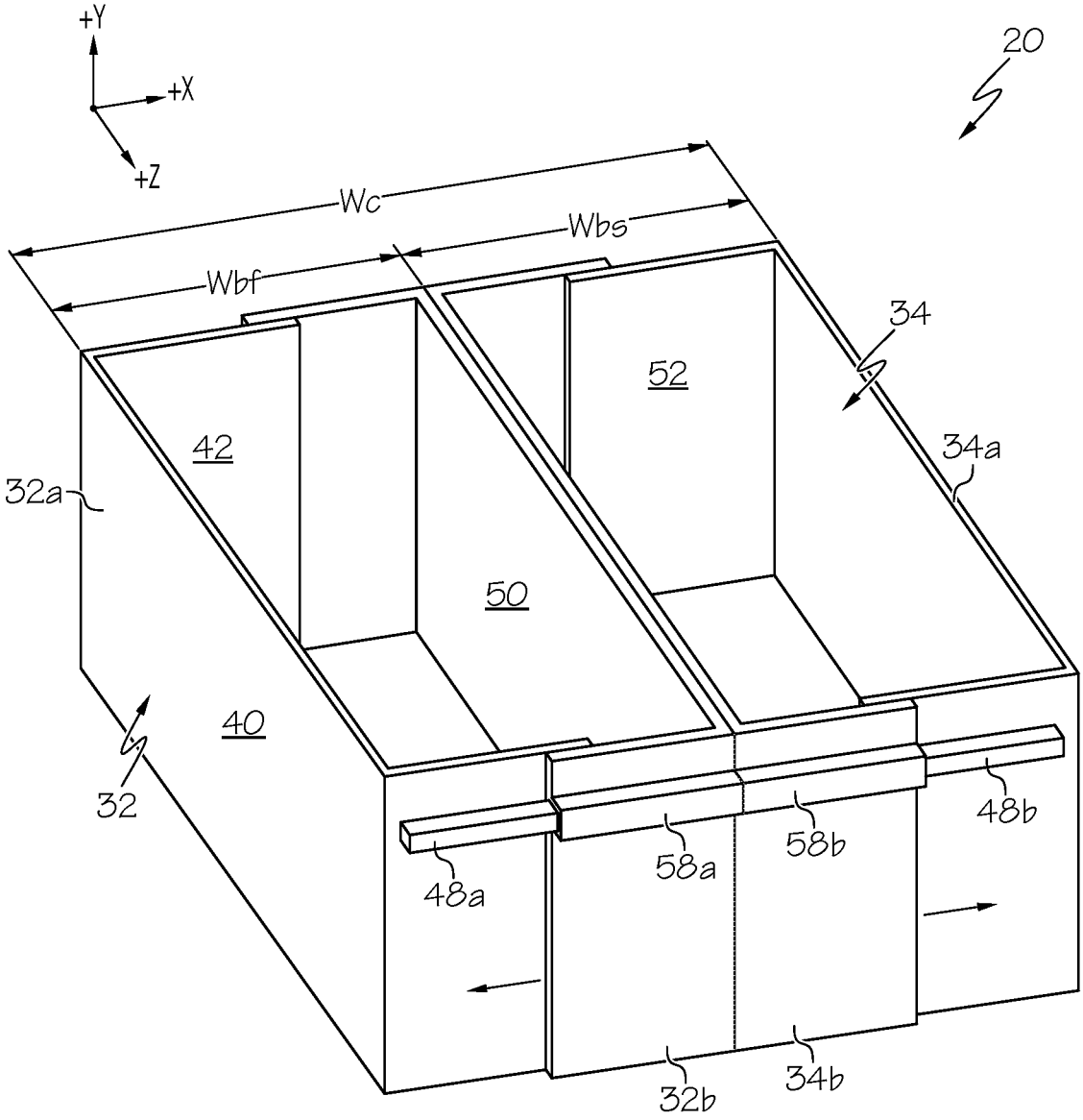
FIG. 3 depicts a perspective view of the container assembly of FIG. 1, according to one or more embodiments shown and described herein.

Referring now to FIG. 3, the container assembly 20 is depicted in additional detail. In these embodiments, and as described herein, the container assembly 20 may include a plurality of bins 30, such as first bin 32 and second bin 34. It should be appreciated that, in the embodiments described herein, the first bin 32 and the second bin 34 may each include the features of the exemplary bin 30 described herein with reference to FIG. 2. That is, each of the first bin 32 and the second bin 34 may include a first section 32*a*, 34*a*, and a second section 32*b*, 34*b*, with the first section 32*a*, 34*a* of each bin 32, 34 including a slider 48*a*, 48*b*, and the second section 32*b*, 34*b* of each bin 32, 34 including a rail 58*a*, 58*b*, that allows the second section 32*b*, 34*b* of each bin 32, 34 to translate relative the first section 32*a*, 34*a*.

In these embodiments, the container assembly 20 may have a container assembly width Wc that is equal to the combined width of each of the plurality of bins 30. Furthermore, although the width of each of the individual bins of the plurality of bins 30 may be adjusted, as described herein with reference to FIG. 2, the container assembly width Wc may be fixed, such that the container assembly width Wc remains constant as the widths of the plurality of bins 30 are adjusted.

In order to adjust the width of each of the plurality of bins 30 while maintain the container assembly width Wc, the adjustment of at least one of the plurality of bins 30 may result in an equal and opposite adjustment of at least one other bin of the plurality of bins 30. For example, as depicted in FIG. 3, the first bin 32 and the second bin 34 may be coupled such that adjusting a width of the first bin 32 causes an inverse adjustment of a width of the second bin 34.

More particularly, the second section 32*b* of the first bin 32 and the second section 34*b* of the second bin 34 may be coupled such that the second section 32*b* of the first bin 32 and the second section 34*b* of the second bin 34 move in tandem in a longitudinal direction (e.g., in the +/−x-direction as depicted in the coordinate axis of FIG. 3). In order to translate the second sections 32*b*, 34*b* of the first and second bin 32, 34 in unison, the first bin 32 and second bin 34 may be aligned such that the slider 48 and rail 58 of each the first bin 32 and the second bin 34 are aligned and always engaged in a lateral direction (e.g., in the +/−z-direction as depicted in the coordinate axis of FIG. 3) and a transverse direction (e.g., in the +/−y-direction as depicted in the coordinate axis of FIG. 3).

Operation of the container assembly 20 will now be described in additional detail with reference to FIG. 3. In these embodiments, the first bin 32 and the second bin 34 of the container assembly 20 may be coupled via an attachment mechanism (e.g., to each other and/or via a partition), as will be described in additional detail herein with reference to FIG. 4. The attachment mechanism may act to releasably couple the second section 32*b* of the first bin 32 with the second section 34*b* of the second bin 34, such that translation of the second section 32*b* of the first bin 32 in the longitudinal direction causes similar translation of the second section 34*b* of the second bin 34. Furthermore, the attachment mechanism may aid in aligning the slider 48*a* and rail 58*a* of the first bin 32 with the slider 48*b* and rail 58*b* of the second bin 34, as has been described herein.

With the first bin 32 and second bin 34 aligned and coupled via the attachment mechanism, the width of the first bin 32 and second bin 34 may be adjusted by translating the second section 32*b*, 34*b* of either the first bin 32 or the second bin 34 in the longitudinal direction. For example, as depicted in FIG. 3, the first bin 32 may have a first bin width Wbf and the second bin 34 may have a second bin width Wbs. Translating the second section 32*b*, 34*b* of either the first or second bin 32, 34 in the longitudinal direction may cause the first bin width Wbf and the second bin width Wbs to change based on the direction in which the first bin 32 or second bin 34 is translated. For example, translating the second section 32*b*, 34*b* of the first bin 32 or the second bin 34 in a first direction (e.g., in the +x-direction as depicted in the coordinate axis of FIG. 3) may cause the first bin width Wbf to increase, while the second bin width Wbs may decrease. In these embodiments, the increase of the first bin width Wbf may be proportional to the decrease of the second bin width Wbs, such that the container assembly width Wc remains fixed. Similarly, moving the first bin 32 or the second bin 34 in a second direction opposite the first direction (e.g., in the −x-direction as depicted in the coordinate axis of FIG. 3) may cause the first bin width Wbf to decrease and the second bin width Wbs to increase in the same manner.

In the embodiments described herein, it should be further noted that the first bin 32 and the second bin 34 may have different dimensions (e.g., length, width, etc.). For example, in some embodiments, a maximum first bin width Wbf may be greater than a maximum second bin width Wbs. In these embodiments, the second section 32*b* of the first bin 32 and the second section 34*b* of the second bin 34 may be moved in the second direction (e.g., in the −x-direction as depicted in the coordinate axis of FIG. 3) such that the first bin width Wbf is equal to the second bin width Wbs. Accordingly, first bin width Wbf and the second bin width Wbs may be equal when the second section 32*b* of the first bin 32 and the second section 34*b* of the second bin 34 are at a leftmost position (e.g., farthest in the −x-direction as depicted by the coordinate axis of FIG. 3) as opposed to a central position (e.g. as depicted in FIG. 3). This configuration may allow for greater variability in the width of each of the first bin 32 and second bin 34 in a first and/or second direction.

In the embodiments described herein, translation of the first bin 32 and the second bin 34 may be limited by the size of the sidewalls 42 formed on the first section 32*a*, 34*a* of the first bin 32 and second bin 34, respectively. For example, when the second section 34*b* of the second bin 34 is translated in the first direction (e.g., in the +x-direction as depicted in the coordinate axis of FIG. 4), the boundary wall 50 of the second section 34*b* may contact the sidewalls 52 of the first section 34*a* of the second bin 34 to prevent further translation of the second section 34*b* of the second bin 34. Similarly, when the second section 32*b* of the first bin 32 is translated in the second direction (e.g., in the −x-direction as depicted in the coordinate axis of FIG. 4), the boundary wall 50 of the second section 32*b* may contact the sidewalls 42 of the first section 32*a* of the first bin 32 to prevent further translation of the second section 32*b* of the first bin 32. Accordingly, it should be appreciated that the variability of the bins (e.g., how much a width of the first bin 32 and/or second bin 34) may be determined based on the width of the sidewalls 42 of each of the first bin 32 and second bin 34.

In the embodiments described herein, it should be further appreciated that the first bin 32 and second bin 34 may further include a stopper mechanism configured to restrict translation of the second section 32*b*, 34*b* of the first bin 32 and second bin 34, respectively. In these embodiments, the stopper mechanism may be formed on the boundary wall 50, the side walls 42, 52, or any other component of each of the first bin 32 and second bin 34 such that the second section 32*b*, 34*b* of each of the first bin 32 and second bin 34 are prevented from translating prior to engaging the sidewalls 42, 52.

Furthermore, although not depicted, in some embodiments the slider 48 and rail 58 of each of the first bin 32 and the second bin 34 may include a locking mechanism, which may be configured to limit translation of the second section 32*b*, 34*b* of each of the first bin 32 and the second bin 34. In these embodiments, the locking mechanism may be positioned between the slider 48 and the rail 58 such that the locking mechanism prevents translation in the first and/or second direction. For example, in the embodiments described herein, the second section 32*b*, 34*b* of each of the first bin 32 and second bin 34 may be configured to translate two inches, four inches, six inches, and/or eight inches in both the first direction and second direction, or any other similar distance, without departing from the scope of the present disclosure. Furthermore, in some embodiments, it should be appreciated that the first bin 32 and the second bin 34 may be translatable different amounts in each direction. For example, the first bin 32 and second bin 34 may be translatable six inches in a first direction and eight inches in a second direction opposite the first direction, or any other combination of distances described herein, without departing from the scope of the present disclosure. In the embodiments described herein, the second section 32*b*, 34*b* of each of the first bin 32 and second bin 34 may be further configured to lock anywhere along their respective movable path (e.g., at ant location as the second section 32*b*, 34*b* of the first and/or second bin 32, 34 translate in the longitudinal direction).

Figure 4:
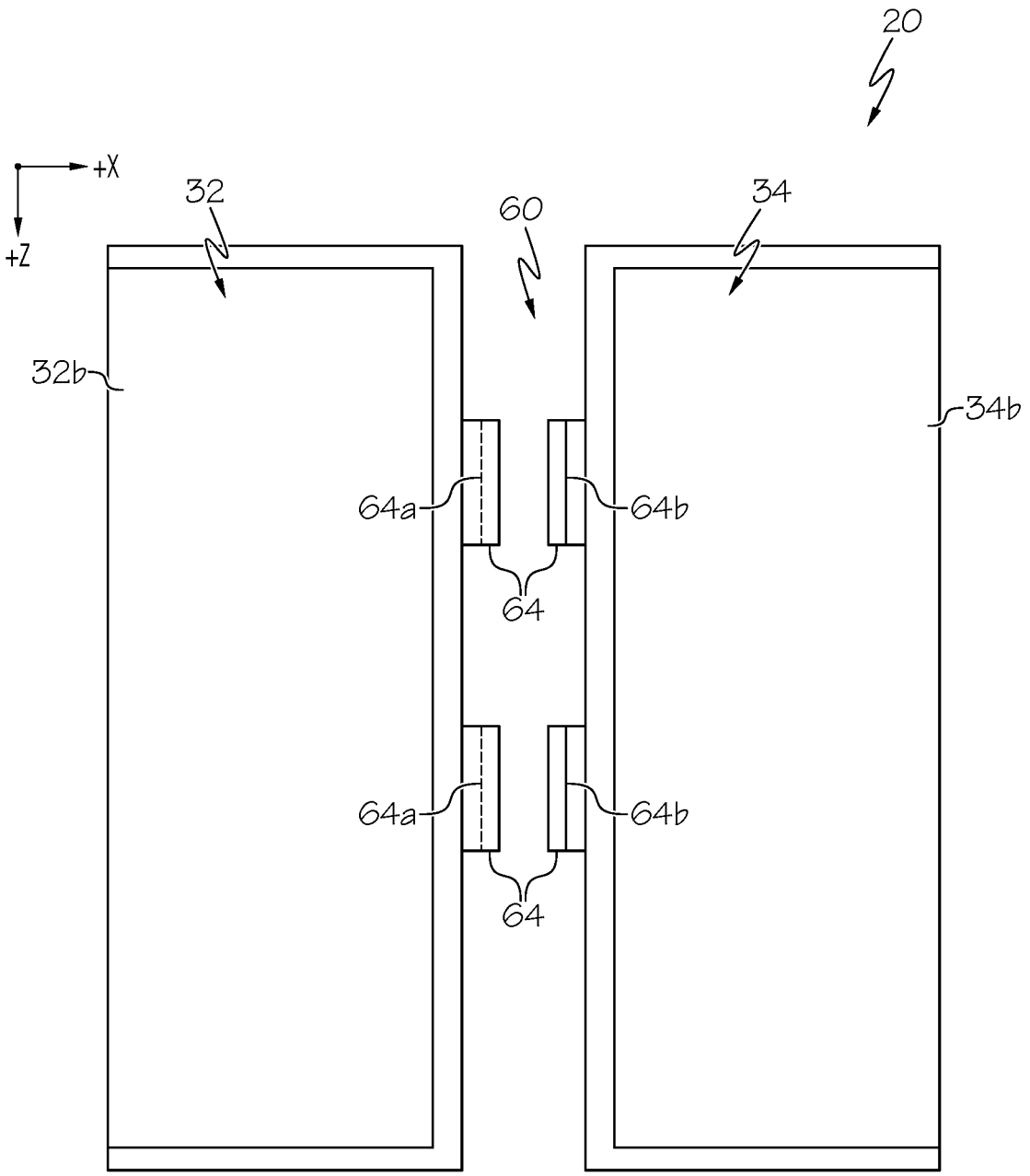
FIG. 4 depicts a top side view of the container assembly of FIG. 2, according to one or more embodiments shown and described herein.

Referring now to FIG. 4, although the first bin 32 and the second bin 34 may be coupled such that the second sections 32*b*, 34*b* of the first bin 32 and second bin 34 move in tandem in the longitudinal direction (e.g., in the +/−x-direction as depicted in the coordinate axis of FIG. 4), the first bin 32 and the second bin 34 may move independently of one another in a lateral direction (e.g., in the +/−z-direction as depicted in the coordinate axis of FIG. 4). For example, in these embodiments, an attachment mechanism 60 may be used to coupled the second section 32*b*, 34*b* of the first bin 32 and the second bin 34 together, such that the first bin 32 and the second bin 34 translate together in the longitudinal direction but may be pulled apart to separately access food and/or other items stored within the individual bins.

For example, as depicted in FIG. 4, the attachment mechanism 60 may include a plurality of hooks 64. In these embodiments, the second section 32*b* of the first bin 32 may include a first plurality of hooks 64*a*, while the second section 34*b* of the second bin 34 includes a second plurality of hooks 64*b*. The first plurality of hooks 64*a* may engage with the second plurality of hooks 64*b* to ensure that, when either the first and/or second bin 32, 34 is translated to increase its width, the opposite bin correspondingly decreases in width, thereby maintaining the dimensions of the container assembly 20. While the first plurality of hooks 64*a* and the second plurality of hooks 64*b* may remain engaged as the first bin and the second bin 32, 34 are translated in the longitudinal direction, applying a force in the lateral direction to either the first bin 32 or the second bin 34 may cause the first plurality of hooks 64*a* and the second plurality of hooks 64*b* to disengage. With the first plurality of hooks 64*a* disengaged from the second plurality of hooks 64*b*, it may be possible to move each bin individually in the lateral direction without affecting the width of either the first bin 32 or the second bin 34. Although each of the first bin 32 and the second bin 34 may be moved in the lateral direction, it should be further appreciated that, in these embodiments, the first bin 32 and the second bin 34 may be translated a distance in the lateral direction that allows for the opening of each of the bins 32, 34 without disengaging either bin 32, 34 from the container assembly 20.

Although the attachment mechanism 60 depicted in FIG. 4 is illustrated as including a plurality of hooks 64, it should be appreciated that the attachment mechanism 60 may include various attachment mechanisms without departing from the scope of the present disclosure. For example, the attachment mechanism may include a plurality of magnets embedded in the first bin 32 and the second bin 34 that hold the second section 32*b*, 34*b* of each of the first bin 32 and the second bin 34 together with magnetic force. Furthermore, the attachment mechanism may include a twist-and-lock mechanism, a button-release mechanism, a clamping mechanism, an interlocking gear system, and/or any other similar attachment mechanism without departing from the scope of the present disclosure.

Figure 5A:
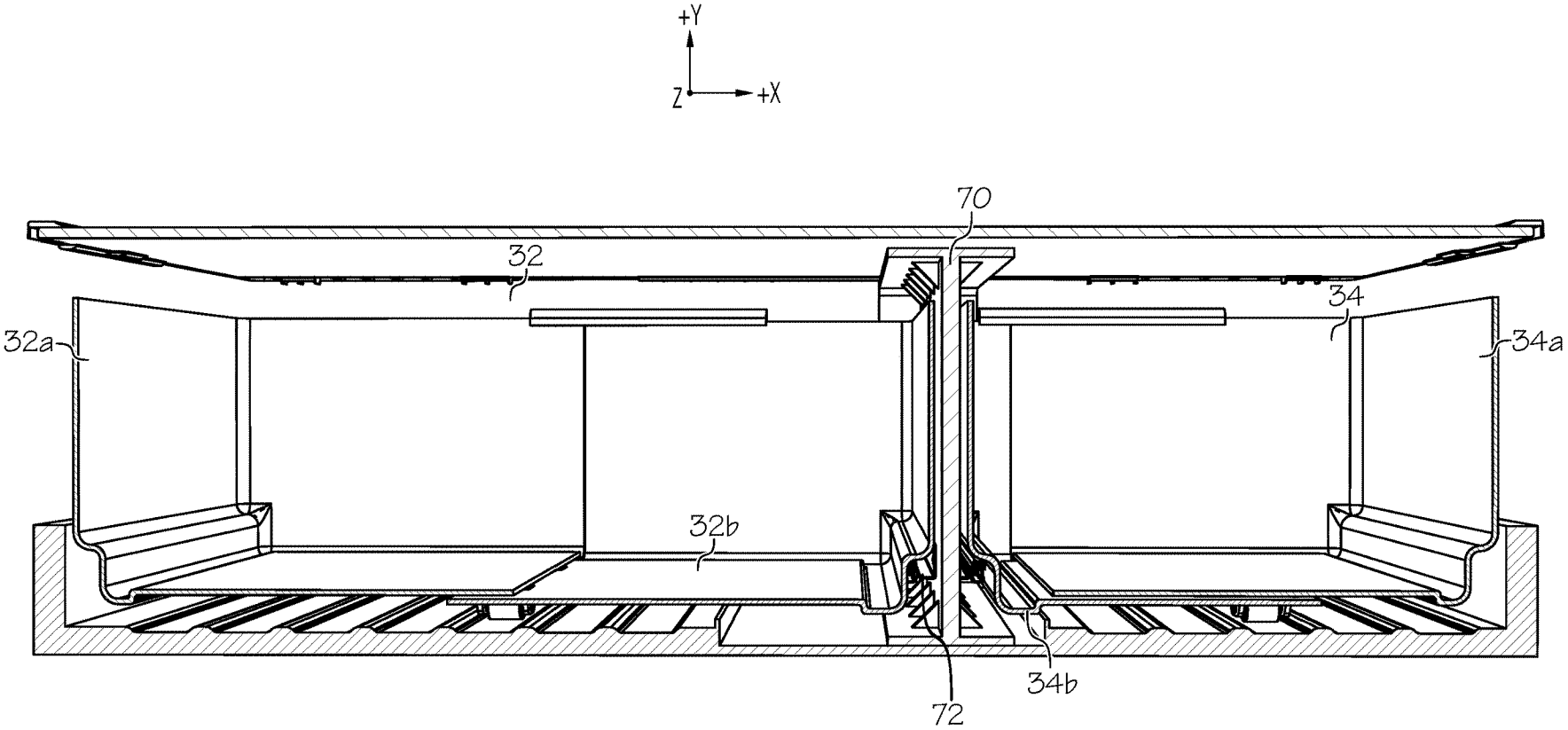
FIG. 5A depicts a partial cross-sectional front side view of another embodiment of the container assembly of FIG. 1, according to one or more embodiment shown and described herein.
Figure 5B:
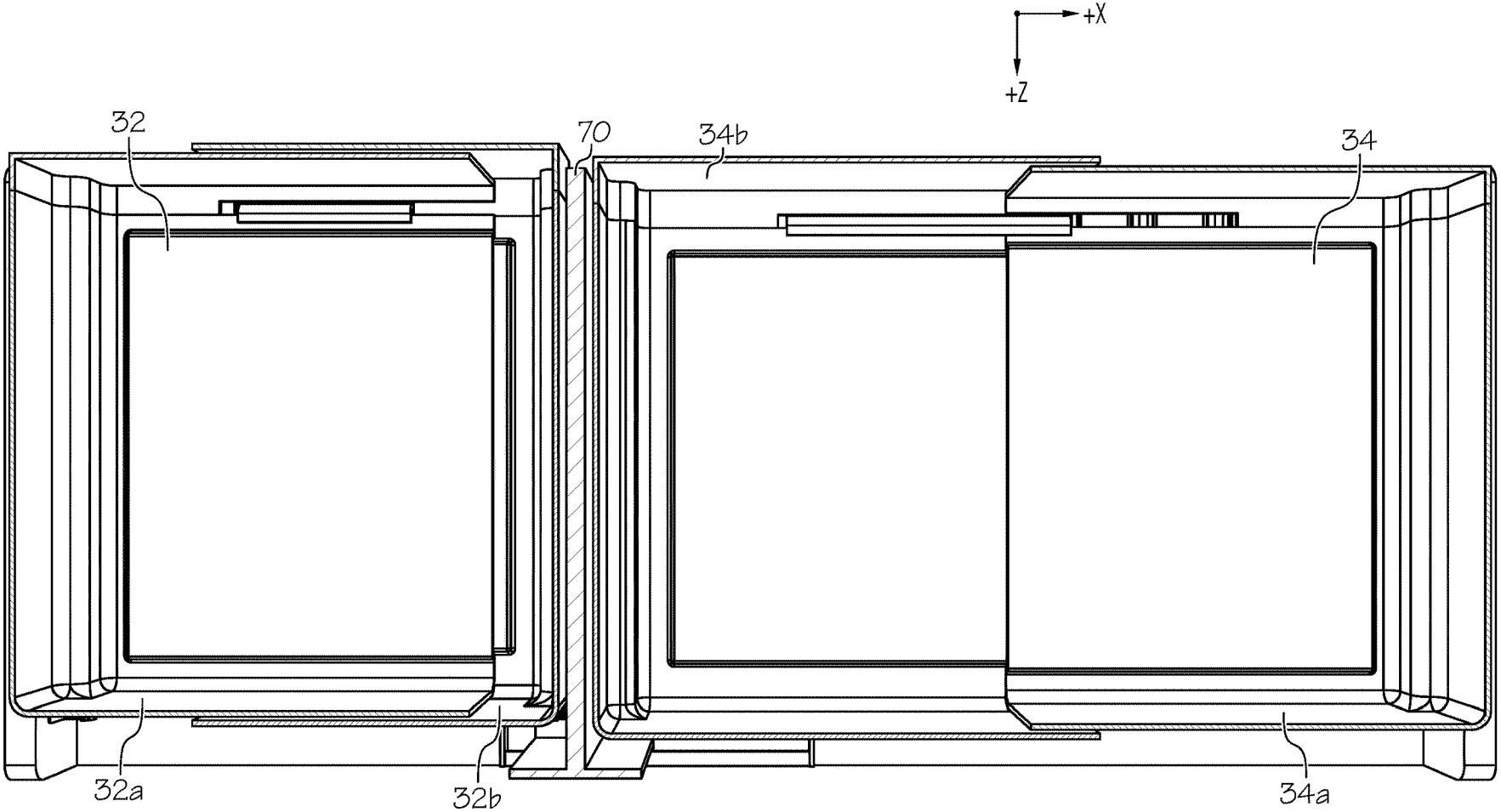
FIG. 5B depicts a partial cross-sectional top side view of the container assembly of FIG. 1, according to one or more embodiments shown and described herein.

Referring now to FIGS. 5A and 5B, another embodiment of a container assembly 20 is depicted. In these embodiments, the container assembly 20 may further include a partition 70 that is positioned between the first bin 32 and second bin 34. In these embodiments, the second section 32*b* of the first bin 32 and the second section 34*b* of the second bin 34 may each be releasably coupled to the partition 70 such that the first bin 32, second bin 34, and partition 70 move in tandem in the longitudinal direction (e.g., in the +/−x-direction as depicted in the coordinate axes of FIGS. 5A and 5B), and the first bin 32 and the second bin 34 may move independently of one another and the partition 70 in a lateral direction (e.g., in the +/−z-direction as depicted in the coordinate axes of FIGS. 5A and 5B).

In these embodiments, the partition 70 may include a plurality of attachment mechanisms 72 configured for coupling the partition 70 to each of the first bin 32 and the second bin 34. Similarly, the first bin 32 and the second bin 34 may include first bin attachment mechanisms and second bin attachment mechanisms (e.g., as depicted in FIG. 4), respectively, for coupling the first bin 32 and the second bin 34 to the partition 70. For example, in the embodiments described herein, each of the attachment mechanisms 72, first bin attachment mechanisms, and second bin attachment mechanisms may include a plurality of hooks, which may be configured to engage one another as has been described herein with reference to FIG. 4.

It should be appreciated that, in some embodiments, the partition 70 may remain stationary in the lateral direction. That is, while the first bin 32 and the second bin 34 may be disengaged from the partition 70 and move in the lateral direction (e.g., in the +/−z-direction as depicted in the coordinate axes of FIGS. 5A and 5B), to translate from an open position to a closed position, the partition 70 may only translate in the longitudinal direction (e.g., in the +/−x-direction as depicted in the coordinate axes of FIGS. 5A and 5B) in order to adjust the respective widths of each of the first bin 32 and second bin 34.

As further depicted in FIGS. 5A and 5B, each of the first bin 32 and second bin 34 may include at least one wheel 80 that may be configured to aid the first bin 32 and the second bin 32 in translating in the lateral direction (e.g., opening and closing). In these embodiments, at least one wheel 80 may be coupled to the base of each of the first bin 32 and the second bin 34, such that the first and second bins 32, 34 may roll in the lateral direction relative the partition 70. Although the first bin 32 and second bin 34 are depicted as including the at least one wheel 80, it should be appreciated that the first and second bins 32, 34 may include any translation mechanism that allows the first and second bins 32 to independently translate in the lateral direction, as has been described in detail herein.

Figure 6:
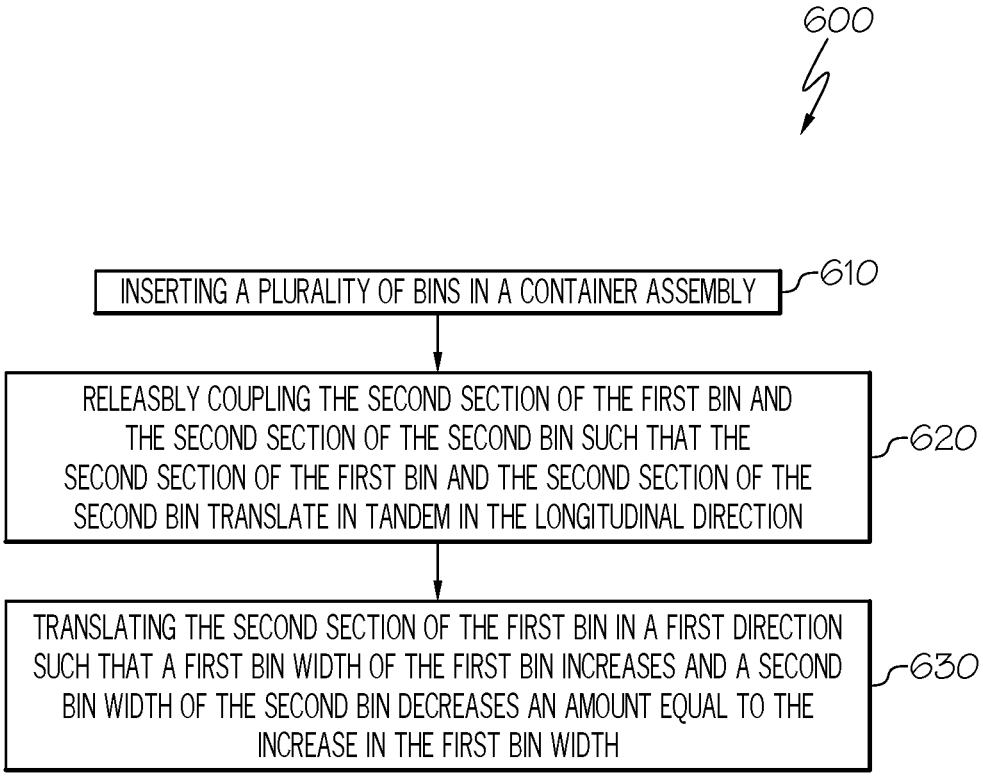
FIG. 6 depicts an illustrative flow diagram of a method of adjusting a width of a container assembly, according to one or more embodiments shown and described herein.

Turning now to FIG. 6, an illustrative method of adjusting a width of a plurality of bins in a container assembly is depicted. As shown at block 610, the method may involve inserting the plurality of bins in the container assembly, with the plurality of bins including a first bin and a second bin, and each of the first bin and the second bin having a first section and a second section that is translatable relative the first section in a longitudinal direction.

Once the plurality of bins have been inserted into the container assembly, the method may advance to block 620, which may include releasably coupling the second section of the first bin and the second section of the second bin such that the second section of the first bin and the second section of the second bin translate in tandem in the longitudinal direction. In these embodiments, it should be appreciated that the method steps of block 610 and block 620 may be completed in reverse order (e.g., the plurality of bins may be coupled prior to being inserted in the container assembly). Furthermore, although the method described herein include a first bin and a second bin, it should be appreciated that any number of bins may be utilized without departing from the scope of the present disclosure.

With each of the plurality of bins releasably coupled, the method may proceed to block 630, which may involve translating the second section of the first bin in a first direction such that a first bin width of the first bin increases and a second bin width of the second bin decreases an amount equal to the increase in the first bin width. In essence, the first bin width and second bin width vary relative each other such that a container assembly width remains constant. For example, as the first bin width increases, the second bin width decreases to accommodate the increase in the first bin width, and vice versa.

As should be appreciated in view of the foregoing, a refrigeration system and container assembly is disclosed. The container assembly includes a plurality of bins each including a first section and a second section, with the second section of each of the plurality of bins being translatable relative the first section of each of the plurality of bins in a longitudinal direction. Accordingly translation of the second section of each of the plurality of bins relative the first section of each of the plurality of bins causes a bin width of each of the plurality of bins to be adjusted. The container assembly may further include an attachment mechanism that may be used to releasably couple the second section of each of the plurality of bins, such that the second sections of each of the plurality of bins move together in tandem when translated in the longitudinal direction. Accordingly, it should be appreciated that translating one of the plurality of bins in a first direction (e.g., to increase the bin width of one of the plurality of bins) results in an equal and opposite decrease in a width of an adjacent bin, such that the overall width of the container assembly is maintained. As a result it may be possible to adjust the widths of each of the plurality of bins in order to accommodate items (e.g., food or otherwise) requiring specific storage space.

Further aspects of the embodiments described herein are provided by the subject matter of the following clauses:

Clause 1. A refrigeration system comprising: an internal cavity; a plurality of shelves and a plurality of drawers disposed within the internal cavity; and a container assembly disposed within the internal cavity, the container assembly comprising: a plurality of bins each including a first section and a second section; wherein the second section of each of the plurality of bins is translatable relative the first section of each of the plurality of bins in a longitudinal direction, such that translation of the second section of each of the plurality of bins relative the first section of each of the plurality of bins causes a bin width of each of the plurality of bins to be adjusted.

Clause 2. The refrigeration system of clause 1, wherein the plurality of bins each include a slider disposed on the first section and a rail disposed on the second section of each of the plurality of bins.

Clause 3. The refrigeration system of clauses 1 or 2, wherein a container assembly width is equal to a combined width of each of the plurality of bins, the container assembly width being fixed.

Clause 4. The refrigeration system of any of clauses 1-3, wherein the plurality of bins includes a first bin and a second bin.

Clause 5. The refrigeration system of any of clauses 1-4, wherein the first bin includes a first bin width and the second bin includes a second bin width.

Clause 6. The refrigeration system of any of clauses 1-5, wherein translating the first bin in a first direction causes the first bin width to increase and the second bin width to decrease an amount equal to the increase of the first bin width.

Clause 7. The refrigeration system of any of clauses 1-6, wherein translating the first bin a second direction causes the first bin width to decrease and the first bin width the increase an amount equal to the decrease of the first bin width.

Clause 8. The refrigeration system of any of clauses 1-7, wherein the container assembly further includes a partition positioned between the first bin and the second bin that is releasably coupled to the second section of each of the plurality of bins.

Clause 9. The refrigeration system of any of clauses 1-9, wherein the partition includes a partition attachment mechanism that allows the plurality of bins to move in tandem in the longitudinal direction and independently in a lateral direction.

Clause 10. A container assembly comprising: a first bin and a second bin, each of the first bin and the second bin including a first section and a second section, the second section being translatable relative the first section in a longitudinal direction; a slider disposed on the first section of each of the first bin and the second bin; a rail disposed on the second section of each of the first bin and the second bin, the rail being configured to engage the slider to allow for translation of the second section relative the first section in the longitudinal direction; and a partition positioned between the first bin and the second bin, the partition including a partition attachment mechanism for releasably coupling to the second section of the first bin and the second section of the second bin; wherein the partition attachment mechanism allows the first bin and the second bin to translate in tandem in the longitudinal direction and move independently in a lateral direction.

Clause 11. The container assembly of clause 10, wherein the attachment mechanism includes a plurality of partition hooks.

Clause 12. The container assembly of clauses 10 or 11, wherein the first bin includes a first plurality of hooks positioned on the second section of the first bin and the second bin includes a second plurality of hooks positioned on the second section of the second bin, the first plurality of hooks and second plurality of hooks being configured to engage the partition attachment mechanism.

Clause 13. The container assembly of any of clauses 10-12, wherein the partition attachment mechanism includes a plurality of magnets.

Clause 14. The container assembly of any of clauses 10-13, wherein a first length of the first section of the first bin is less than a second length of the second section of the second bin.

Clause 15. The container assembly of any of clauses 10-14, wherein the first section and the second section of each of the first bin and the second bin are formed as a single inseparable structure.

Clause 16. The container of any of clauses 10-15, wherein the rail defines a recess for engaging the slider.

Clause 17. The container assembly of any of clauses 10-16, wherein the first section of each of the first bin and the second bin include a pair of sidewalls and the second section of each of the first bin and the second bin include a boundary wall.

Clause 18. The container assembly of any of clauses 10-17, wherein when the first bin and the second bin are translated, contact between the boundary wall of the second section and the pair of sidewalls of the first section limit translation of the first bin and the second bin in the longitudinal direction.

Clause 19. The container assembly of any of clauses 10-18, wherein translating the first bin in a first direction causes a first bin width to increase and a second bin width to decrease an amount equal to the increase of the first bin width.

Clause 20. A method of adjusting a width of a plurality of bins in a container assembly, the method comprising: inserting the plurality of bins in the container assembly, the plurality of bins including a first bin and a second bin, each of the first bin and the second bin having a first section and a second section that is translatable relative the first section in a longitudinal direction; releasably coupling the second section of the first bin and the second section of the second bin to a partition positioned between the first bin and the second bin such that the second section of the first bin and the second section of the second bin translate in tandem in the longitudinal direction; and translating the second section of the first bin in a first direction such that a first bin width of the first bin increases and a second bin width of the second bin decreases an amount equal to the increase in the first bin width.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A refrigeration system comprising:

an internal cavity;

a plurality of shelves and a plurality of drawers disposed within the internal cavity; and a container assembly disposed within the internal cavity, the container assembly comprising:

a plurality of bins each including a first section and a second section, wherein:

the second section of each of the plurality of bins is translatable relative the first section of each of the plurality of bins in a longitudinal direction, such that translation of the second section of each of the plurality of bins relative the first section of each of the plurality of bins causes a bin width of each of the plurality of bins to be adjusted; and the container assembly further includes a partition positioned between the first bin and the second bin that is releasably coupled to the second section of each of the plurality of bins.

2. The refrigeration system of claim 1, wherein the plurality of bins each include a slider disposed on the first section and a rail disposed on the second section of each of the plurality of bins.

3. The refrigeration system of claim 1, wherein a container assembly width is equal to a combined width of each of the plurality of bins, the container assembly width being fixed.

4. The refrigeration system of claim 1, wherein the plurality of bins includes a first bin and a second bin.

5. The refrigeration system of claim 4, wherein the first bin includes a first bin width and the second bin includes a second bin width.

6. The refrigeration system of claim 5, wherein translating the first bin in a first direction causes the first bin width to increase and the second bin width to decrease an amount equal to the increase of the first bin width.

7. The refrigeration system of claim 6, wherein translating the first bin a second direction causes the first bin width to decrease and the first bin width the increase an amount equal to the decrease of the first bin width.

8. The refrigeration system of claim 1, wherein the partition includes a partition attachment mechanism that allows the plurality of bins to move in tandem in the longitudinal direction and independently in a lateral direction.

9. A container assembly for a refrigeration system, the refrigeration system comprising:

an internal cavity;

a plurality of shelves and a plurality of drawers disposed within the internal cavity; and the container assembly, the container assembly comprising:

a first bin and a second bin, each of the first bin and the second bin including a first section and a second section, the second section being translatable relative the first section in a longitudinal direction;

a slider disposed on the first section of each of the first bin and the second bin;

a rail disposed on the second section of each of the first bin and the second bin, the rail being configured to engage the slider to allow for translation of the second section relative the first section in the longitudinal direction; and a partition positioned between the first bin and the second bin, the partition including a partition attachment mechanism for releasably coupling to the second section of the first bin and the second section of the second bin;

wherein the partition attachment mechanism allows the first bin and the second bin to translate in tandem in the longitudinal direction and move independently in a lateral direction.

10. The container assembly of claim 9, wherein the partition attachment mechanism includes a plurality of hooks.

11. The container assembly of claim 10, wherein the first bin includes a first plurality of hooks positioned on the second section of the first bin and the second bin includes a second plurality of hooks positioned on the second section of the second bin, the first plurality of hooks and second plurality of hooks being configured to engage the partition attachment mechanism.

12. The container assembly of claim 9, wherein the partition attachment mechanism includes a plurality of magnets.

13. The container assembly of claim 9, wherein a first length of the first section of the first bin is less than a second length of the second section of the second bin.

14. The container assembly of claim 9, wherein the first section and the second section of each of the first bin and the second bin are formed as a single inseparable structure.

15. The container assembly of claim 9, wherein the rail defines a recess for engaging the slider.

16. The container assembly of claim 9, wherein the first section of each of the first bin and the second bin include a pair of sidewalls and the second section of each of the first bin and the second bin include a boundary wall.

17. The container assembly of claim 16, wherein when the first bin and the second bin are translated, contact between the boundary wall of the second section and the pair of sidewalls of the first section limit translation of the first bin and the second bin in the longitudinal direction.

18. The container assembly of claim 17, wherein translating the first bin in a first direction causes a first bin width to increase and a second bin width to decrease an amount equal to the increase of the first bin width.

19. A method of adjusting a width of a plurality of bins in a container assembly, the method comprising:

providing a refrigeration system with the container assembly, the refrigeration system comprising an internal cavity in which the container assembly, a plurality of shelves, and a plurality of drawers are disposed;

inserting the plurality of bins in the container assembly, the plurality of bins including a first bin and a second bin, each of the first bin and the second bin having a first section and a second section that is translatable relative the first section in a longitudinal direction;

releasably coupling the second section of the first bin and the second section of the second bin to a partition positioned between the first bin and the second bin such that the second section of the first bin and the second section of the second bin translate in tandem in the longitudinal direction; and translating the second section of the first bin in a first direction such that a first bin width of the first bin increases and a second bin width of the second bin decreases an amount equal to the increase in the first bin width.

* * * * *